US009938787B2

(12) United States Patent
Zakharia et al.

(10) Patent No.: US 9,938,787 B2
(45) Date of Patent: Apr. 10, 2018

(54) FULLY SUPPORTED C-RING SLIP RETENTION SYSTEM

(71) Applicant: Dril-Quip, Inc., Houston, TX (US)

(72) Inventors: Steven M. Zakharia, Houston, TX (US); Curtis W. Payne, Richmond, TX (US); Frank D. Kalb, Cypress, TX (US)

(73) Assignee: Dril-Quip, Inc., Houston, TX (US)

( * ) Notice: Subject to any disclaimer, the term of this patent is extended or adjusted under 35 U.S.C. 154(b) by 149 days.

(21) Appl. No.: 15/040,741

(22) Filed: Feb. 10, 2016

(65) Prior Publication Data

US 2017/0226815 A1 Aug. 10, 2017

(51) Int. Cl.
*E21B 23/01* (2006.01)
*E21B 43/10* (2006.01)

(52) U.S. Cl.
CPC ..... *E21B 23/01* (2013.01); *E21B 43/108* (2013.01)

(58) Field of Classification Search
CPC ..... E21B 23/01; E21B 43/08; E21B 43/10; E21B 43/103; E21B 43/108; E21B 33/03; E21B 33/04; E21B 33/068; E21B 33/129; E21B 17/1007
See application file for complete search history.

(56) References Cited

U.S. PATENT DOCUMENTS 6,382,324 B1 * 5/2002 Anyan ..... E21B 17/06 166/115
6,761,221 B1 7/2004 Yokley et al.
9,027,658 B2 * 5/2015 Bories ..... E21B 33/0415 166/208
2012/0012305 A1 1/2012 Yokley
2013/0206427 A1 8/2013 Reimert et al.
2013/0213661 A1 * 8/2013 Reimert ..... E21B 33/043 66/348
2014/0096977 A1 4/2014 Gette et al.
2017/0044862 A1 * 2/2017 Javed ..... E21B 23/06
2017/0152721 A1 * 6/2017 Bories ..... E21B 33/04

OTHER PUBLICATIONS

Office Action issued in related GB Application No. 1701925.8, dated May 25, 2017 (4 pages).

* cited by examiner

*Primary Examiner* — D. Andrews
*Assistant Examiner* — Yanick A Akaragwe
(74) *Attorney, Agent, or Firm* — Baker Botts L.L.P.

(57) ABSTRACT

An improved c-ring slip retention system and method for extraction of the c-ring slip are provided. The c-ring slip retention system may use an axially movable support sleeve with a support ring for securing the c-ring slip against a retention lip of the liner hanger body. The disclosed retention system prevents the c-ring slip from being prematurely extracted from a liner hanger body while the liner hanger is lowered through a borehole. The c-ring slip retention system may also include anti-rotation features that prevent the c-ring slip from rotating relative to the liner hanger body. A single actuation of the support sleeve in an axial direction may unlock the c-ring slip from the retention lip, disengage the anti-rotation features, compress the c-ring slip out of the keyed profile, and extract the c-ring slip from the liner hanger body.

20 Claims, 10 Drawing Sheets

FULLY SUPPORTED C-RING SLIP RETENTION SYSTEM

TECHNICAL FIELD

The present disclosure relates generally to liner hangers and, more particularly, to a fully supported c-ring slip retention system for use in a liner hanger.

BACKGROUND

When drilling a well, a borehole is typically drilled from the earth's surface to a selected depth and a string of casing is suspended and then cemented in place within the borehole. A drill bit is then passed through the initial cased borehole and is used to drill a smaller diameter borehole to an even greater depth. A smaller diameter casing is then suspended and cemented in place within the new borehole. This is conventionally repeated until a plurality of concentric casings are suspended and cemented within the well to a depth which causes the well to extend through one or more hydrocarbon producing formations.

Rather than suspending a concentric casing from the bottom of the borehole to the surface, a liner is often suspended adjacent to the lower end of the previously suspended casing, or from a previously suspended and cemented liner, so as to extend the liner from the previously set casing or liner to the bottom of the new borehole. A liner is defined as casing that is not run to the surface. A liner hanger is used to suspend the liner within the lower end of the previously set casing or liner.

A running and setting tool disposed on the lower end of a work string may be releasably connected to the liner hanger, which is attached to the top of the liner. The work string lowers the liner hanger and liner into the open borehole until the liner hanger is adjacent the lower end of the previously set casing or liner, with the lower end of the liner typically slightly above the bottom of the open borehole. When the liner reaches the desired location relative to the bottom of the open borehole and the previously set casing or liner, a setting mechanism is conventionally actuated to move an anchoring element (e.g., slips) on the liner hanger from a compressed position to an expanded position and into engagement with the previously set casing or liner. Thereafter, when set down weight is applied to the anchoring body, the anchoring element is set to support the liner.

The liner hanger anchoring element can include a radially expandable and contractable c-ring with slip teeth formed about its outer and inner edge and a frustoconical tapered surface for supporting the liner within the previously set casing or liner. Typically, the c-ring slip (or anchoring body) is held in a compressed position within a recess in the body of the liner hanger while the liner hanger is lowered through the borehole. The c-ring slip is then moved out of the recess in the body of the liner hanger, and into its expanded position.

Unfortunately, the c-ring slip can sometimes become dislodged from the recess in the liner hanger body while the liner hanger is being lowered through the borehole, thereby unintentionally expanding the anchoring element before the liner hanger is ready to be set. This premature expansion of the anchoring element can cause undesirable delays, since the liner hanger assembly must be removed from the wellbore and the anchoring element reset.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
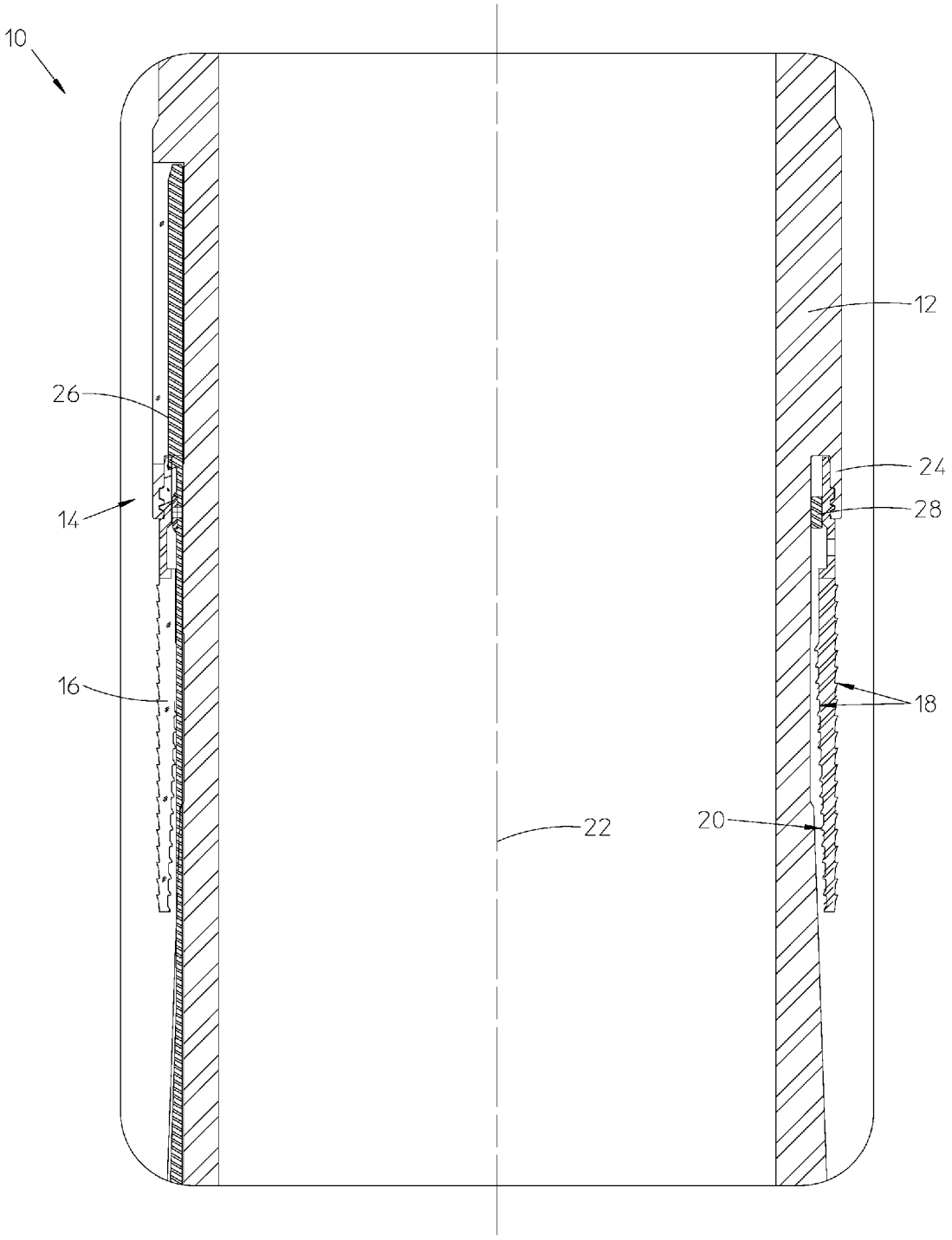
FIG. 1 is a cutaway view of a liner hanger assembly having a fully supported c-ring slip retained in a locked position, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a liner hanger with a fully supported c-ring slip retention system and associated method for retaining and extracting the c-ring slip to set the liner hanger.

Liner hangers typically retain a c-ring slip in a compressed position under a lip of the liner hanger body as the liner hanger is being lowered downhole. Once the liner hanger reaches a desired location within a previously set casing or liner, existing systems often utilize tie-bars to remove the c-ring slip from the lip to set the liner hanger. Unfortunately, such tie-bars are susceptible to buckling failure modes when impact forces act on the c-ring slip. In addition, the c-ring slip can sometimes become dislodged from the lip in the liner hanger body while the liner hanger is being lowered through the borehole, thereby prematurely and unintentionally releasing the slip or anchoring element.

The disclosed embodiments address the deficiencies of previous liner hanger designs by providing an improved c-ring slip retention system, which allows for a "fully supported c-ring slip". The c-ring slip retention system may use an axially movable support sleeve with a support ring for securing the c-ring slip against a retention lip of the liner hanger body. In some embodiments, the liner hanger body and the c-ring slip may be constructed with specifically keyed profiles that enable a tight fit and distribution of impact forces from the c-ring slip to the rest of the liner hanger. The disclosed retention system also prevents the c-ring slip from prematurely dislodging from the liner hanger body while the liner hanger is being lowered through a borehole.

The c-ring slip retention system may also include anti-rotation features that prevent the c-ring slip from rotating relative to the liner hanger body. Such anti-rotation features may include shoulders on the support sleeve designed to engage with corresponding slots formed in the c-ring slip to eliminate or minimize rotation of the c-ring slip.

In the disclosed liner hanger system and method, the support sleeve may be axially displaced to extract the c-ring slip from the liner hanger body, allowing the c-ring slip to expand and set the liner hanger. Such actuation of the support sleeve in the axial direction may simultaneously unlock the c-ring slip from its position within the retention lip and disengage the anti-rotation features. In some embodiments, extracting the c-ring slip from the retention lip may involve moving the support ring relative to the c-ring slip to enable the c-ring slip to compress and move past the locking profile on the retention lip. In certain embodiments, disengaging the anti-rotation features may involve axially moving the support sleeve such that the anti-rotation shoulders on the support sleeve are withdrawn from the corresponding slot walls and into expanded portions of the slots.

The disclosed c-ring slip retention system and method for extraction of the c-ring slip may facilitate a more reliable liner hanger that prevents premature release of the slip or anchoring element. The retention system and anti-rotation features keep the c-ring slip in a desired axial, radial, and angular position prior to extraction. The system enables effective transfer of large axial/radial forces and torques that might act on the c-ring slip while the liner hanger is being lowered downhole, while facilitating extraction of the c-ring slip via the application of a relatively small actuation force.

Turning now to the drawings, FIG. 1 is a cutaway view of a liner hanger 10 having a fully supported c-ring slip, in accordance with an embodiment of the present disclosure. The liner hanger 10 includes a liner hanger body 12 and an improved c-ring slip retention system 14 for retaining a c-ring slip 16 in a locked/compressed position within the liner hanger 10. It is desirable to maintain the c-ring slip 16 in this locked/compressed position while the liner hanger 10 is being lowered down a borehole, to avoid premature setting of the liner hanger 10. The c-ring slip 16 is a radially expandable and contractable c-ring having slip teeth 18 formed about its outer edge and its inner edge, and a frustoconical tapered surface 20 for supporting the liner hanger 10 within a previously set casing or liner (not shown). As described in detail below, the liner hanger 10 may also include anti-rotation features to prevent a rotation of the c-ring slip 16 about a longitudinal axis 22 of the liner hanger 10 while the c-ring slip 16 is disposed in the locked position.

In the illustrated embodiment, the c-ring slip retention system 14 may include a retention lip 24 formed in the liner hanger body 12, a support sleeve 26, and a support ring 28. The retention lip 24 is a lip formed around the liner hanger body 12, and the lip 24 extends in a direction parallel to the liner hanger longitudinal axis 22. The retention lip 24 defines a cavity between the lip 24 and the rest of the liner hanger body 12 for receiving and holding the c-ring slip 16 when the c-ring slip 16 is in a compressed state. The support sleeve 26 may include one or more sleeve portions that are disposed within the liner hanger body 12 and axially movable relative to the liner hanger body 12. The support ring 28 is a ring disposed around the support sleeve 26.

Figure 2:
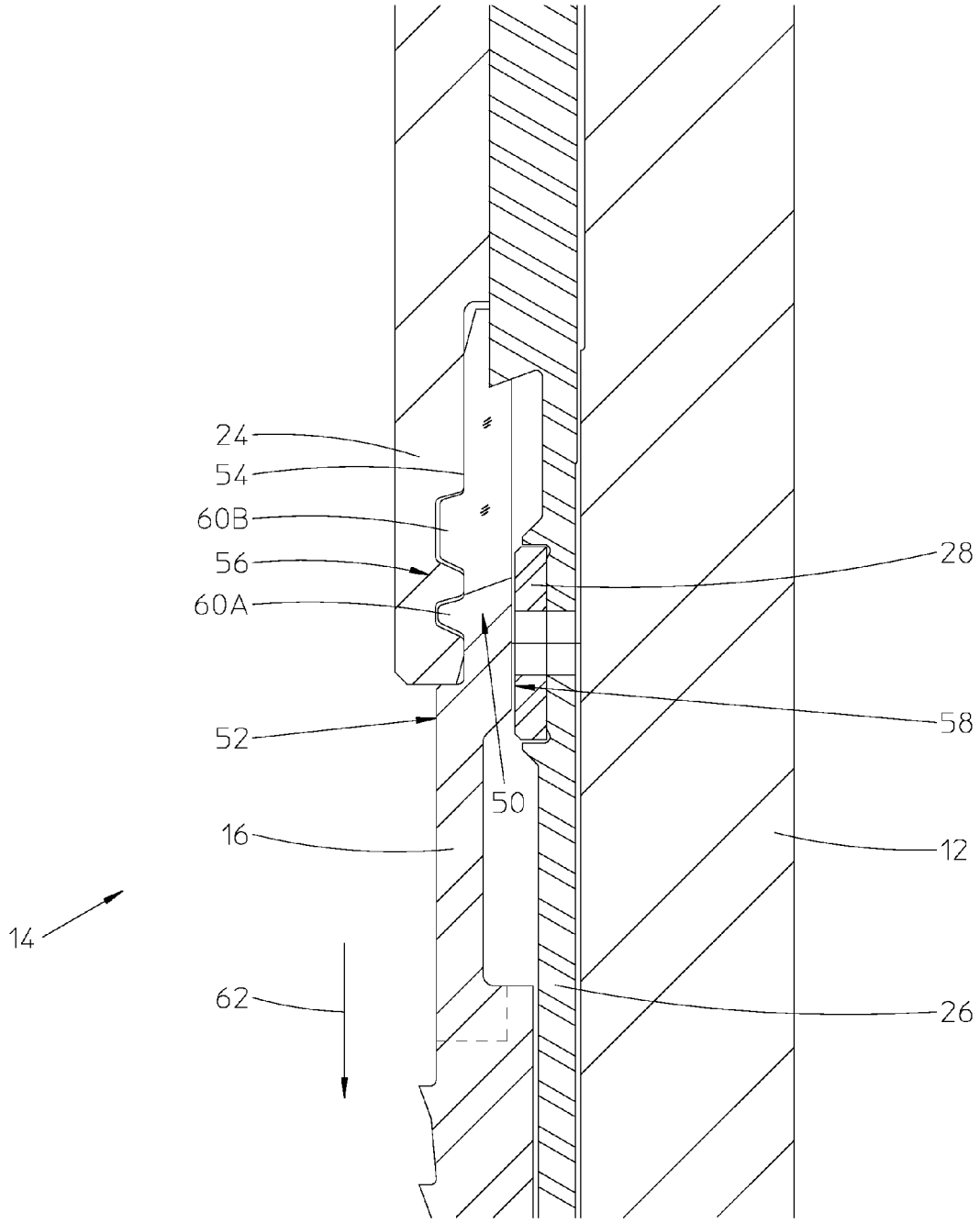
FIG. 2 is a cutaway view of a slip retention system used in the liner hanger assembly of FIG. 1, in accordance with an embodiment of the present disclosure.

A more detailed view of the c-ring slip retention system 14 is illustrated in FIG. 2. The illustrated c-ring slip retention system 14 may be a two-part slip retention system. The first part of the c-ring slip retention system 14 is the interface between the c-ring slip 16 and the retention lip 24. Specifically, the c-ring slip 16 may include a profile 50 facing an inner wall 54 of the retention lip 24. The inner wall 54 of the retention lip 24 may include a complementary profile 56 for receiving the profile 50 of the c-ring slip 16 and thereby retaining the c-ring slip 16. The profiles 50 and 56 may be specifically keyed to provide a precision fit between the c-ring slip 16 and the retention lip 24.

The second part of the c-ring slip retention system 14 is the support ring 28 disposed against an inner surface 58 of the c-ring slip 16. The support ring 28 may bias the c-ring slip 16 radially outward and into a secure engagement (via interlocking profiles 50 and 56) with the inner wall 54 of the retention lip 24.

In the illustrated embodiment, the retaining profile 50 of the c-ring slip 16 may include two shoulders 60, and the complementary profile 56 on the retention lip 24 may be sized to receive the corresponding shoulders 60 when the c-ring slip retention system 14 is locked. As illustrated, the two shoulders 60 may have different widths from each other. These "widths" may be measured in a direction parallel to the longitudinal axis 22 of the liner hanger 10. For example, a first (front) shoulder 60A disposed closer to the extended edge of the retention lip 24 may have a smaller width than a second (back) shoulder 60B located further from the extended edge of the retention lip 24. This arrangement may prevent the back shoulder 60B from becoming caught in the portion of the retention lip profile 56 sized to interface with the smaller front shoulder 60A as the c-ring slip 16 is extracted from the retention lip 24. In other embodiments, the two shoulders 60 may have different heights from each other to achieve a similar effect.

Although two shoulders 60 are illustrated in FIG. 2, in other embodiments the interlocking profiles 50 and 56 may include any suitable number of shoulders 60. In still other embodiments, the profiles 50 and 56 may include any desirable type and number of keyed features that create a precision fit between the outer edge 52 of the c-ring slip 16 and the inner wall 54 of the retention lip 24.

Figure 6:
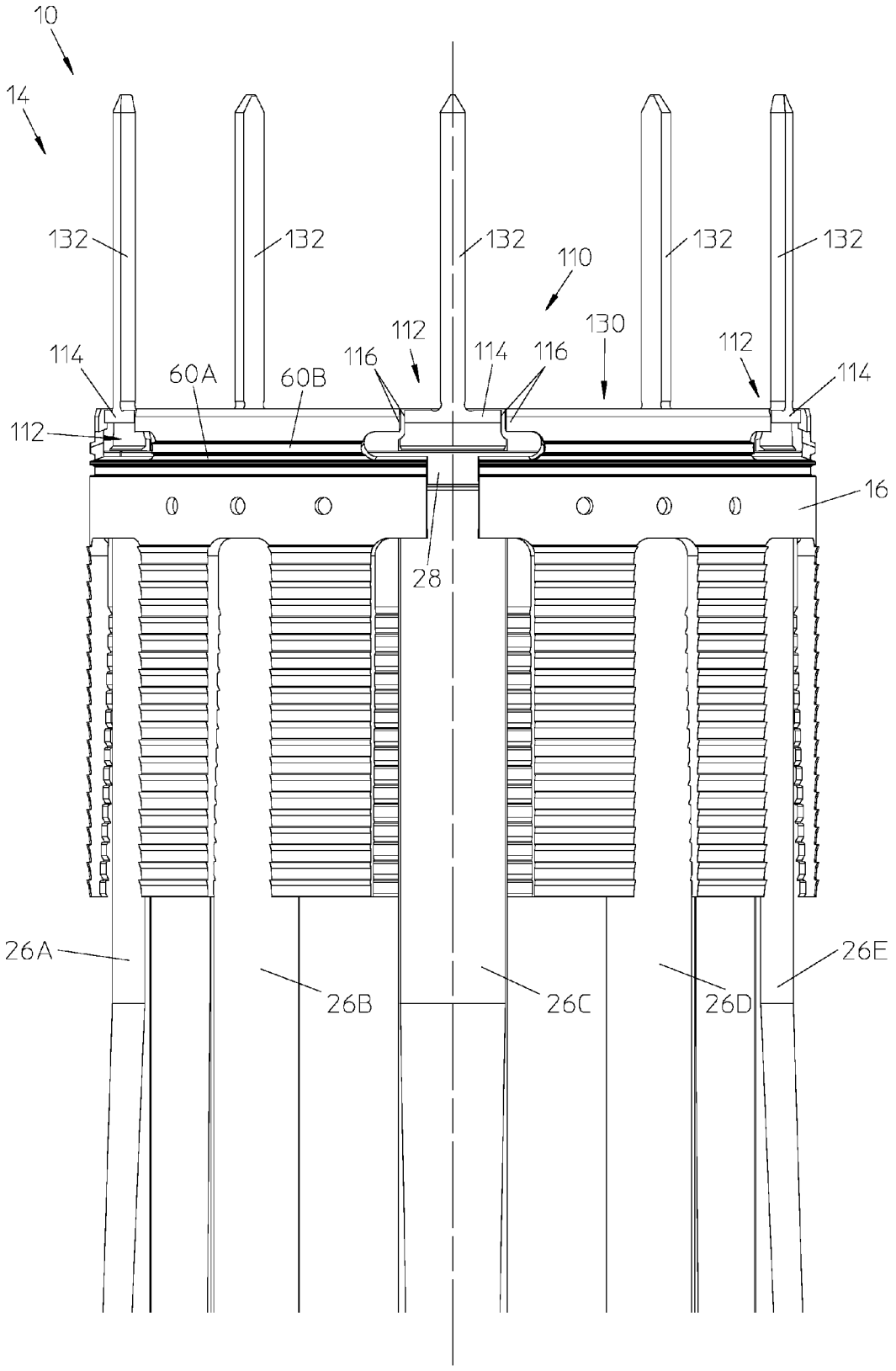
FIG. 6 is a perspective view of certain components of the liner hanger assembly of FIG. 1 in a run-in position, in accordance with an embodiment of the present disclosure.

The shoulders 60 may span the circumference of the c-ring slip 16, so as to provide a relatively large area of interference between the c-ring slip 16 and the retention lip 24. In some embodiments, as shown in FIG. 6 for example, the front shoulder 60A may span nearly 360 degrees around the c-ring slip 16 (except for at the break in the c-ring). The back shoulder 60B, as shown in FIG. 6, may be separated by T-slots 112 periodically disposed around the circumference of the c-ring slip 16.

Turning back to FIG. 2, the c-ring slip 16 is generally supported from below by the support ring 28, which biases the c-ring slip 16 into engagement with the profile 56 of the retention lip 24. The support ring 28 may be axially held in place by the support sleeve 26, with respect to the longitudinal axis (22) of the liner hanger (10). This arrangement allows the outwardly biased c-ring slip 16 to be mechanically locked into place against the retention lip 24 with full circumferential contact at the shoulders 60.

The c-ring slip retention system 14 may prevent the c-ring slip 16 from being pulled out of the retention lip 24 if, for example, debris catches on the outer edge (e.g., slip teeth 18) of the c-ring slip 16 while the liner hanger 10 is being lowered through a borehole. If a force of impact acts on the c-ring slip 16 (e.g., in direction 62), the force would be transmitted into the retention lip 24 via the keyed interlocking profiles 50 and 56. The axial force (62) may then be converted to a radial load on the support ring 28 and a tension load on the liner hanger body 12. This transfer of forces within the c-ring slip retention system 14 may prevent premature release of the c-ring slip 16 from the retention lip 24. It should be noted that the disclosed slip retention system 14 does not utilize tiebars like conventional liner hangers. Therefore, the slip retention system 14 eliminates buckling as a failure mode by allowing the axial impact force 62 to be converted into radial force that is transmitted into the liner hanger body 12 via the support ring 28.

Figure 3:
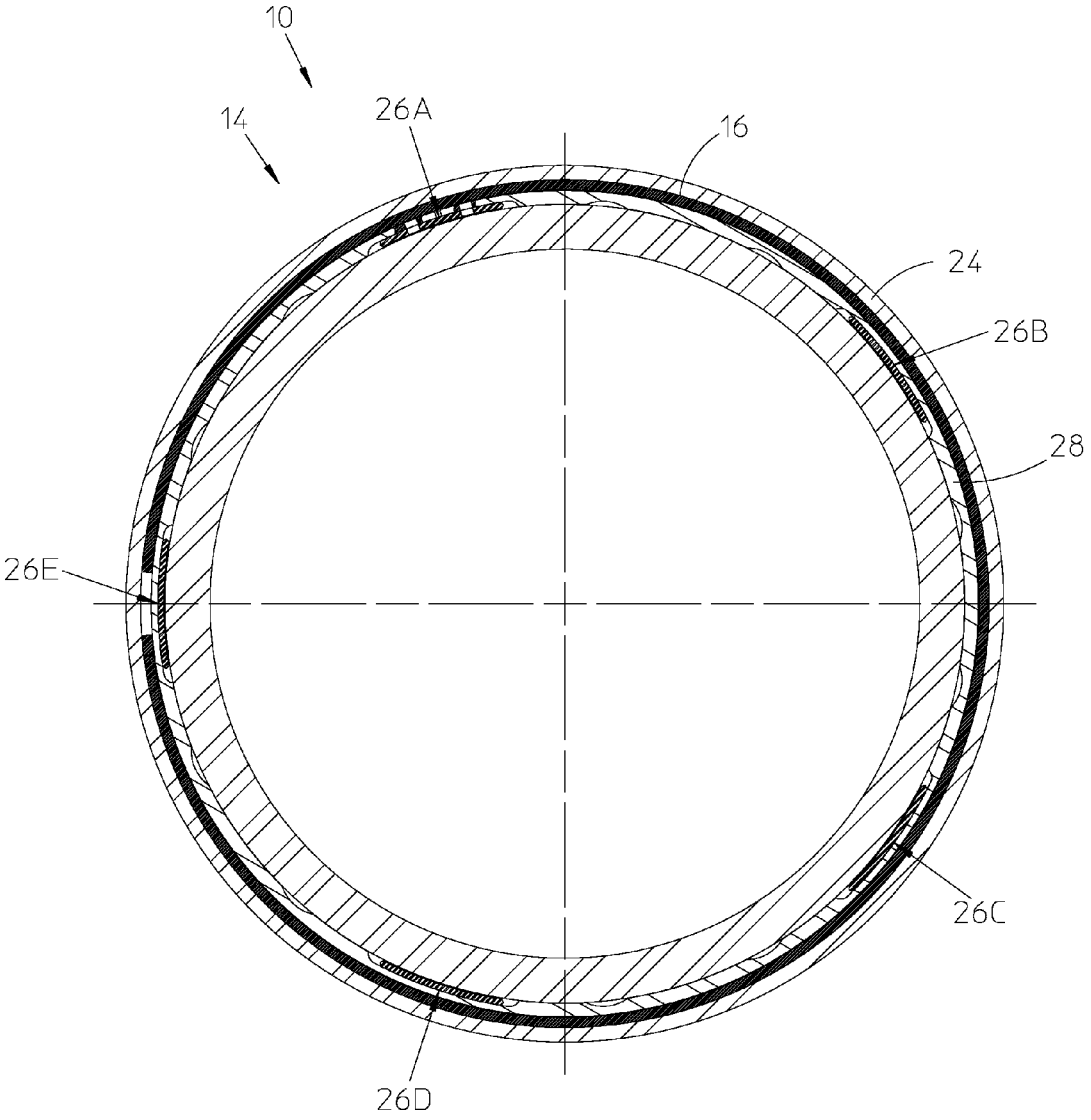
FIG. 3 is a radial cross sectional view of the slip retention system of the liner hanger assembly of FIG. 1, in accordance with an embodiment of the present disclosure

FIG. 3 is a radial cross sectional view of the slip retention system 14, taken through the axial location of the support ring 28. In the illustrated embodiment, the slip retention system 14 is in the locked/compressed position for maintaining the c-ring slip 16 within the retention lip 24. As shown, the support ring 28 is disposed against the c-ring slip 16 and biases the c-ring slip 16 against the retention lip 24. The support sleeve 26 may include a number of support sleeve fingers 26A-E disposed about a circumference of the liner hanger body 12.

Figure 4:
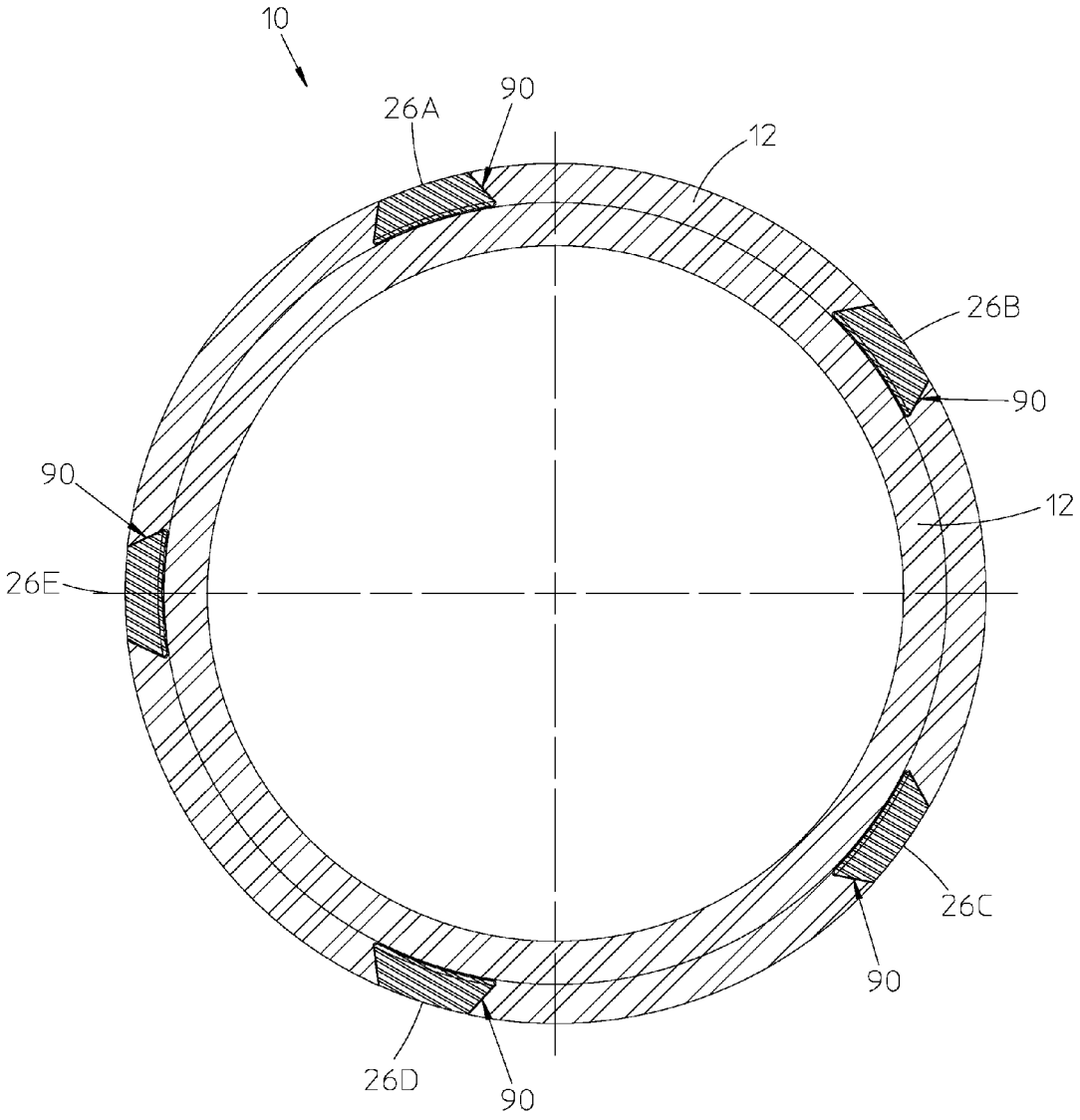
FIG. 4 is a radial cross sectional view of a support sleeve held within a body of the liner hanger assembly of FIG. 1, in accordance with an embodiment of the present disclosure.

FIG. 4 is another radial cross sectional view of the liner hanger 10, taken at an axial position away from the slip retention system 14. At this position of the liner hanger 10, the support sleeve fingers 26A-E may each extend through dovetail slots 90 formed in the liner hanger body 12. The dovetail slots 90 may prevent the support sleeve 26 from buckling and help resist torsion on the support sleeve 26 by preventing rotational movement of the support sleeve relative to the liner hanger body 12.

Turning back to FIG. 3, the support ring 28 may be disposed around and coupled to the support sleeve portions 26, as shown. By disposing the support ring 28 around the support sleeve portions 26, the system enables a relatively easy installation method for the liner hanger 10. That is, the sleeve fingers 26A-E may be individually disposed through cavities (e.g., dovetail slots 90) in the liner hanger body 12, and the support ring 28 may be snapped around the support sleeve 26. The support ring 28 may hold the support sleeve portions 26 together (e.g., as a single unit) and provide a circumferential interface between the support sleeve 26 and the c-ring slip 16.

As mentioned above, the disclosed c-ring slip retention system 14 may include anti-rotation features that substantially prevent the c-ring slip 16 from rotating relative to the longitudinal axis of the liner hanger while the liner hanger is tripping in a borehole. Such anti-rotation features may be particularly suitable for use in "slim-line" liner hangers. However, other conventional sized liner hangers may benefit from the anti-rotation features as well.

Figure 5:
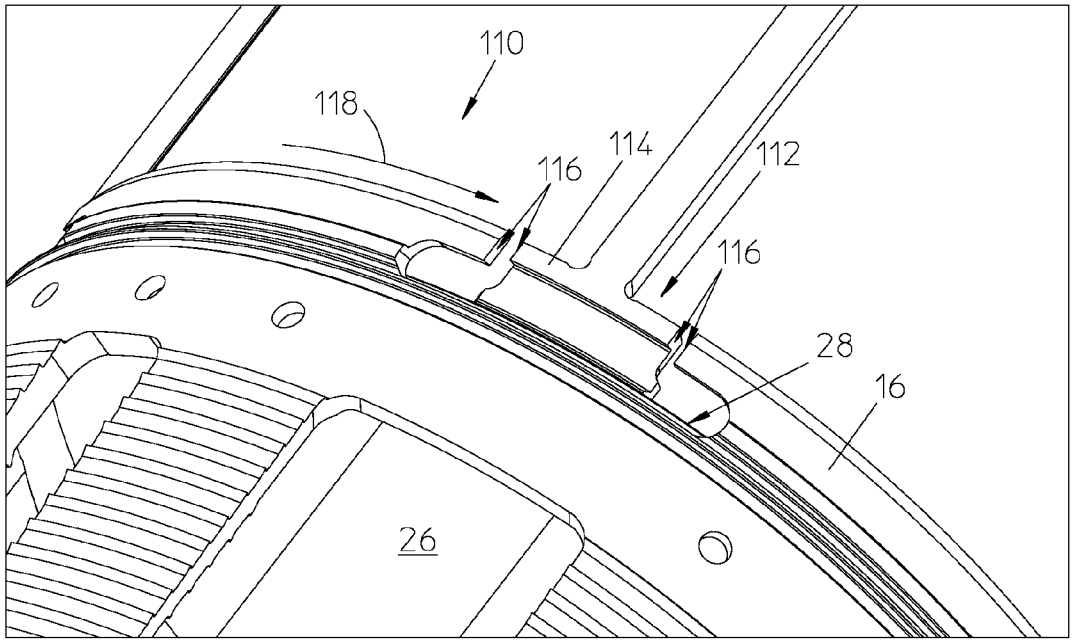
FIG. 5 is a perspective view of an anti-rotation feature where the support sleeve finger extends through a T-slot in the c-ring slip of the liner hanger assembly of FIG. 1, in accordance with an embodiment of the present disclosure.

FIG. 5 illustrates an embodiment of anti-rotation features 110 that may be used to prevent rotation of the c-ring slip 16 relative to the liner hanger body 12. The anti-rotation features 110 may include a T-slot 112 formed in the c-ring slip 16 and a corresponding anti-rotation portion 114 of the support sleeve 26. The anti-rotation portion 114 of the support sleeve 26 may be positioned within the T-slot 112 of the c-ring slip 16 to minimize rotation of the c-ring slip 16 relative to the support sleeve 26 (and consequently to the liner hanger body 12 because of the support sleeve fingers 26 in the dovetail slots 90) prior to extraction of the c-ring slip 16 from the retention lip 24.

To that end, the c-ring slip 16 and the anti-rotation portion 114 of the support sleeve 26 may each include anti-rotation shoulders 116, as shown. The c-ring slip 16 may include opposing anti-rotation shoulders 116 on opposite sides (or walls) of the T-slot 112, while the anti-rotation sleeve portion 114 may include anti-rotation shoulders 116 on opposite edges thereof to interface with the anti-rotation shoulders 116 of the T-slot 112.

Any torsional load (e.g., in a rotational direction 118) imparted on the c-ring slip 16 may be transmitted through the anti-rotation shoulders 116 into the support sleeve 26 and into the dovetail slots 90 of the liner hanger body 12, thereby preventing further rotation of the c-ring slip 16. In this manner, the anti-rotation features 110 substantially prevent rotation of the c-ring slip 16 relative to the support sleeve 26. The anti-rotation features 110 may allow only a minimal rotation of the c-ring slip 16 (i.e., just far enough for the anti-rotation shoulder 116 of the T-slot 112 to engage the shoulder 116 of the anti-rotation sleeve portion 114).

Figure 7:
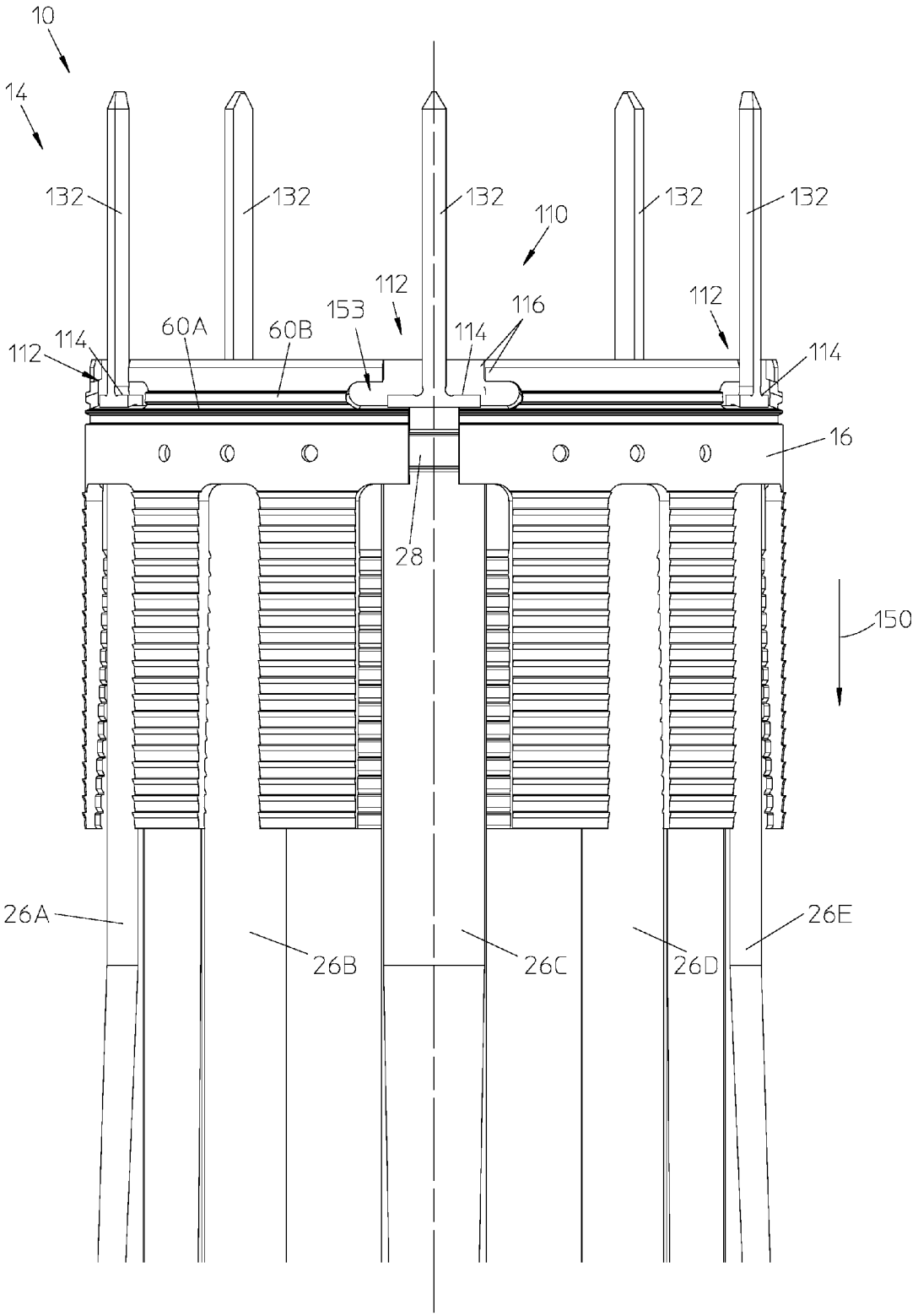
FIG. 7 is a perspective view of certain component of the liner hanger assembly of FIG. 1 in an unlocked position, in accordance with an embodiment of the present disclosure.

FIGS. 6 and 7 illustrate a more detailed view of the support sleeve 26, support ring 28, and c-ring slip 16 of the c-ring slip retention system 14 having the above described anti-rotation features 110. The anti-rotation features 110 may include five T-slots 112 that are strategically machined at an end 130 (facing opposite the slip teeth 18) of the c-ring slip 16. The T-slots 112 may be assembled in conjunction with the five corresponding support sleeve fingers 26A-E that make up the support sleeve 26. In other embodiments, different numbers (e.g., 1, 2, 3, 4, 6, 7, 8, 9, or more) of the T-slots 112 and corresponding support sleeve fingers may be utilized within the system to prevent rotation of the c-ring slip 16 while the slip retention system 14 is locked.

In FIG. 6, the slip retention system components are shown in the "locked/compressed" position (i.e., for retaining the c-ring slip 16 within the retention lip). In general, the liner hanger 10 may be lowered down a borehole in this locked/compressed position, so that no external forces acting on the c-ring slip 16 lead to premature extraction of the c-ring slip 16.

While the liner hanger 10 is being moved downhole in the locked position, any torsional loads (e.g., rotational impact forces) acting on the c-ring slip 16 may be easily transmitted through the support sleeve 26 to the large liner hanger body 12. Specifically, a rotational impact force applied to the c-ring slip 16 may be transferred from the c-ring slip 16 to the anti-rotation portion 114 of the support sleeve 26 via the flat anti-rotation shoulders 116. The support sleeve 26 may be disposed within and connected to the liner hanger body 12 (not shown) through the support sleeve fingers 26A-E extending into dovetail slots (90 of FIG. 3) of the liner hanger body 12. The dovetail slots 90 work together to strengthen the support sleeve fingers 26A-E and provide an adequate reaction force to the rotational impact transferred from the c-ring slip 16.

Figure 8:
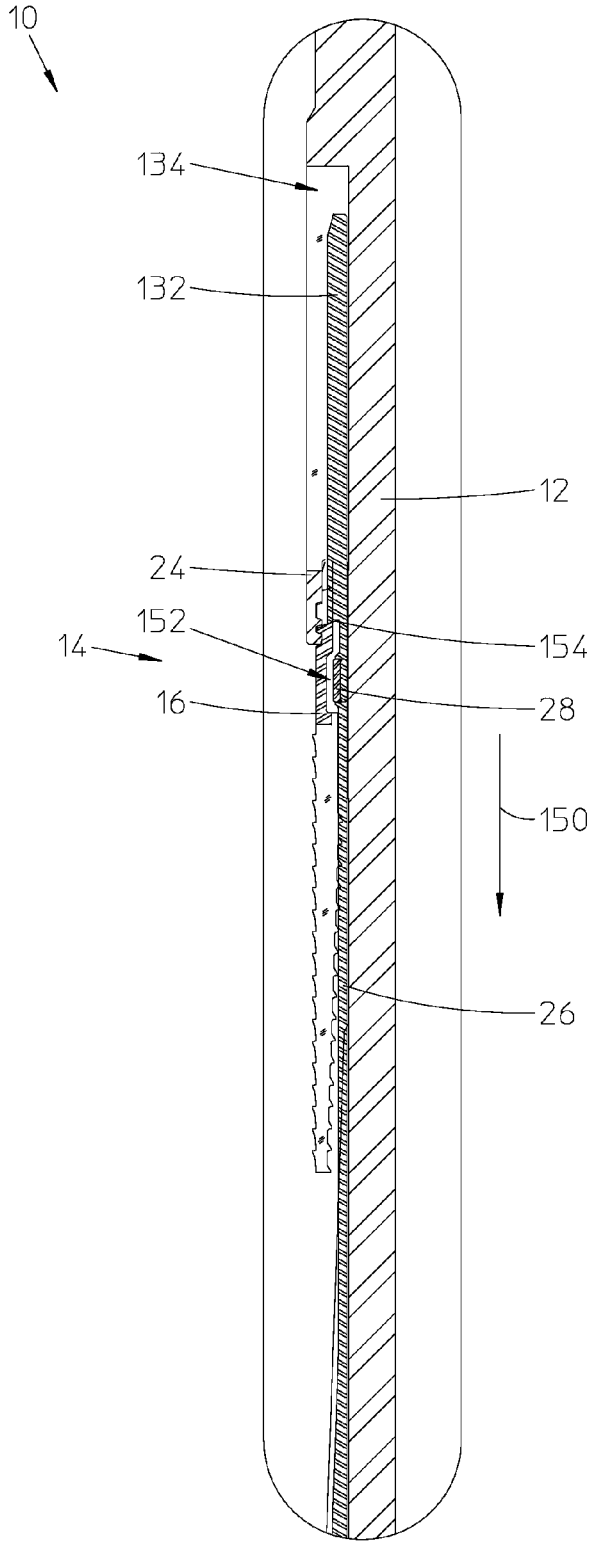
FIG. 8 is a cutaway view of the slip retention system of FIG. 1 being unlocked, in accordance with an embodiment of the present disclosure.
Figure 9:
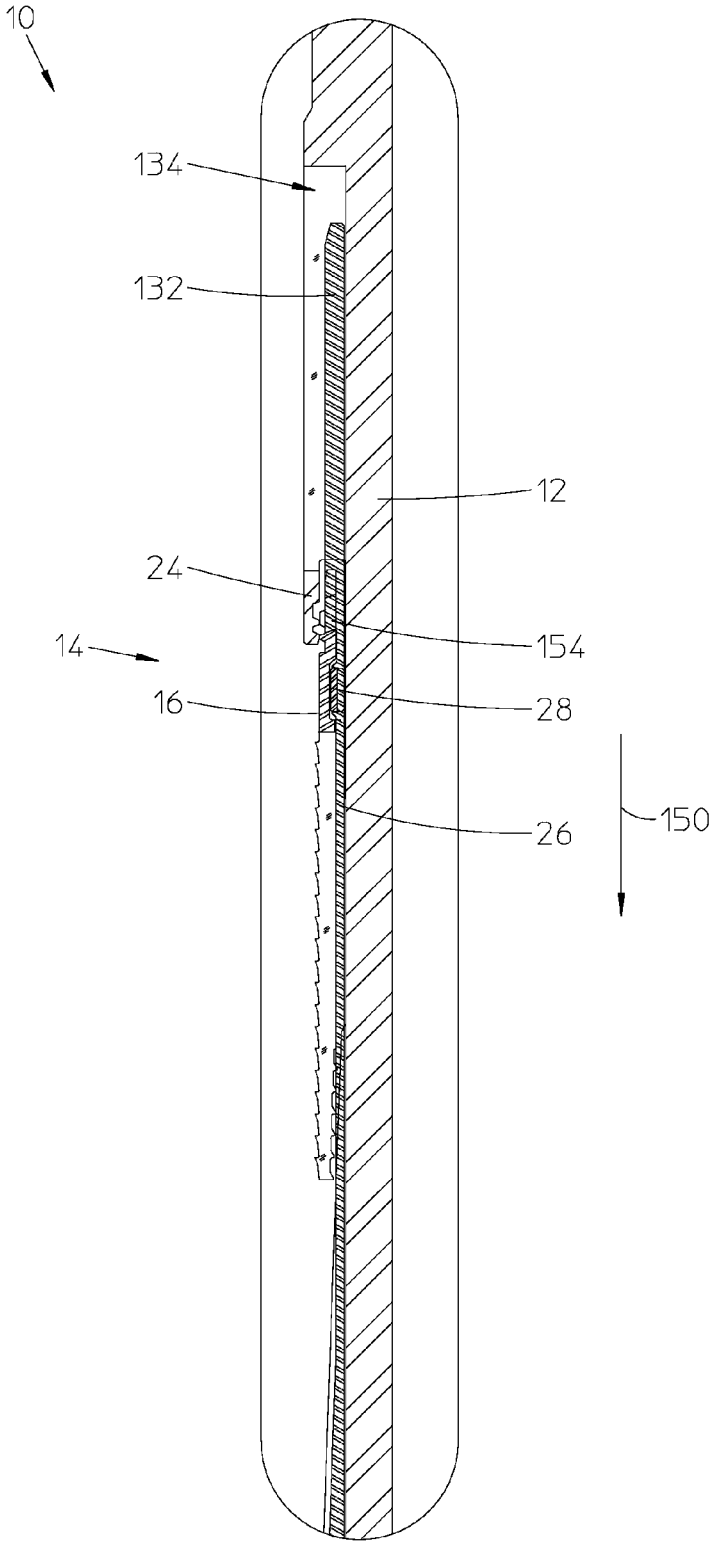
FIG. 9 is a cutaway view of the slip retention system of FIG. 1 with the c-ring slip being compressed, in accordance with an embodiment of the present disclosure.
Figure 10:
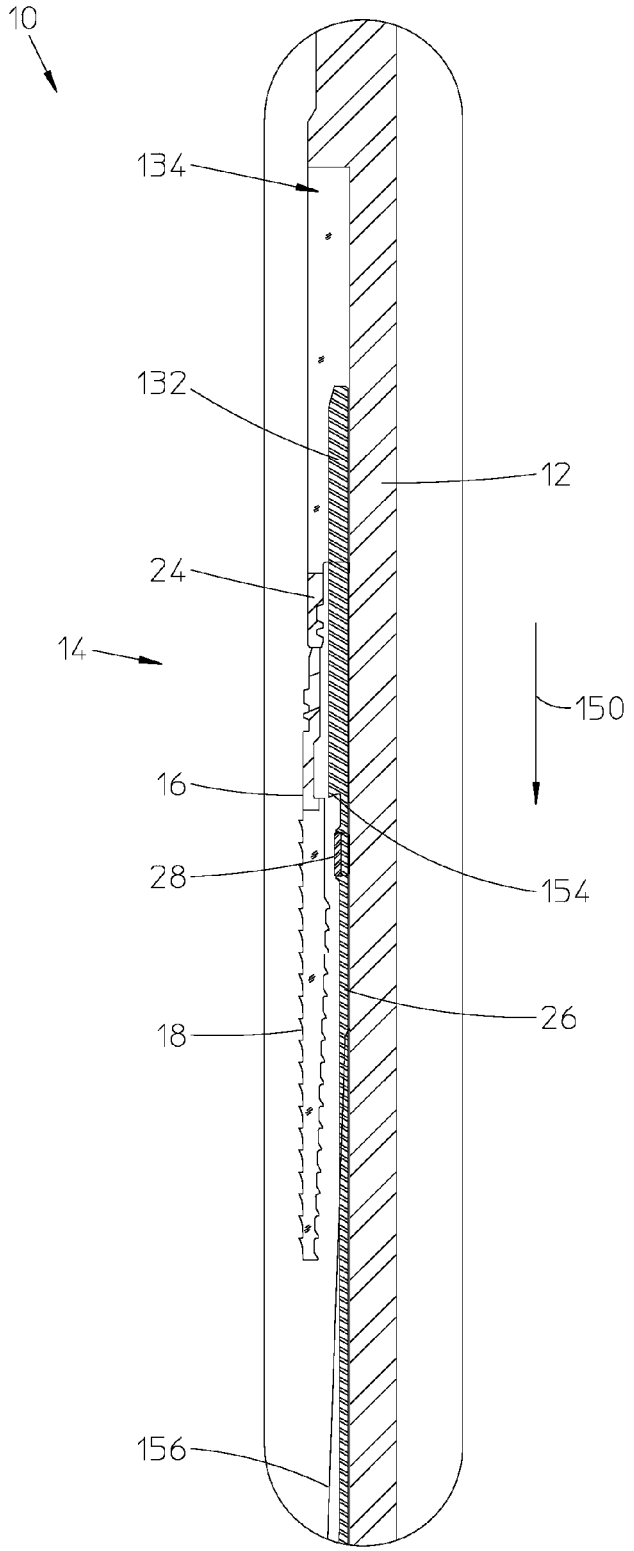
FIG. 10 is a cutaway view of the slip retention system of FIG. 1 with the c-ring slip being extracted, in accordance with an embodiment of the present disclosure.

The support sleeve 26 may also transmit rotational impact forces from the c-ring slip 16 to the liner hanger body 12 through one or more stingers 132. As illustrated, each support sleeve portion 26 may include a stinger 132 extending longitudinally from the anti-rotation portion 114 of the support sleeve 26. As shown in FIGS. 8-10, the liner hanger body 12 may include elongated slots 134 formed therethrough for receiving and holding the stingers 132. The liner hanger 10 may be constructed such that the stingers 132 are maintained at least partially within the elongated slots 134 of the liner hanger body 12 even after the support sleeve is actuated to fully extract the c-ring slip 16. In this way, the support sleeve 26 may be continually piloted within the liner hanger body 12 as it is actuated axially between the "locked/compressed" position and a slip extraction position.

A detailed description of the method for unlocking the disclosed c-ring slip retention system 14 to extract the c-ring slip 16 will now be provided. In the locked/compressed position described above with reference to FIGS. 1, 2, and 6, the c-ring slip 16 may be mechanically locked to prevent any radial motion (via slip retention system 14) as well as any angular motion (via anti-rotation features 110). It is generally desirable to unlock both locking mechanisms (14 and 110) prior to releasing the c-ring slip 16.

In some embodiments, a hydraulically actuated piston on a liner hanger running tool may pull axially uphole on the support sleeve 26, thereby moving the support sleeve in an axial direction. Actuating the support sleeve 26 in the axial direction may unlock the c-ring slip retention system 14 and the anti-rotation features 110 at approximately the same time. A relatively small amount of force may be applied to actuate the support sleeve 26 to unlock the system. The slip retention system 14, however, may be able to transmit a much greater amount of force from the c-ring slip 16 to the liner hanger body 12 when the c-ring slip 16 is retained in the locked position.

FIGS. 8-10 illustrate the support sleeve 26 being used to extract the c-ring slip 16 from the retention lip 24 of the liner hanger 10. As illustrated, the c-ring slip 16 may include a recess 152 for receiving the support ring 28 as the support sleeve 26 is axially moved (150) relative to the c-ring slip 16. Actuation of the support sleeve 26 may withdraw the support ring 28 into the recess 152 of the c-ring slip 16. This effectively unlocks the c-ring slip retention system 14, since the support ring 28 is no longer pushing against and biasing the c-ring slip 16 into engagement with the profile on the retention lip 24. The slip retention system 14 is shown in the "unlocked" position in FIG. 8.

FIG. 7 illustrates another view of slip retention components shown in the "unlocked" position. As mentioned above, the slip retention system 14 is moved to this unlocked position through actuation of the support sleeve 26 in the axial direction 150 away from the retention lip 24 (not shown). This actuation of the support sleeve 26 may also unlock the anti-rotation features 110 present within the system. Specifically, actuation of the support sleeve 26 may withdraw each anti-rotation portion 114 (having anti-rotation shoulders) of the support sleeve 26 into an expanded portion 153 of the corresponding T-slot 112. In this manner, actuating the support sleeve 26 in the direction 150 to unlock the slip retention system 14 may also unlock the anti-rotation features 110.

Turning again to FIG. 8, once the c-ring slip retention system 14 and/or anti-rotation features 110 are unlocked, further actuation of the support sleeve 26 in the direction 150 may compress the c-ring slip 16 to a smaller diameter. The c-ring slip 16 is configured to compress radially inward when the support ring 28 is disposed in the recess 152. As the support sleeve 26 is actuated further, a sloped face (back angle) 154 on an extraction shoulder of the support sleeve 26 is brought into engagement with a corresponding sloped surface of the c-ring slip 16. The sloped face 154 may aid in removal of the c-ring slip 16 by guiding the compression of the c-ring slip 16 to a smaller diameter in response to axial movement of the support sleeve 26.

The slip retention system 14 is shown in the compressed position in FIG. 9. As illustrated, compression of the c-ring slip 16 to this smaller diameter disengages the c-ring slip 16 from the profile 56 of the retention lip 24. It should be noted that compression of the c-ring slip 16 may only be possible using the support sleeve 26 once the slip retention system 14 has been unlocked such that the c-ring slip 16 is no longer forced against the retention lip 24 by the support ring 28.

After compressing the c-ring slip 16, the running tool may continue to stroke the support sleeve 26 in the axial direction 150 until the outwardly biased c-ring slip 16 has been completely extracted from the retention lip 24 of the liner hanger body 12. The c-ring slip 16 is shown in the fully extracted position in FIG. 10. Once the c-ring slip 16 has been fully extracted, the c-ring slip 16 may expand radially outward. This outward expansion enables the slip teeth 18 to engage with a frustoconical tapered surface 156 of the liner hanger body 12 on one side, and with an inner diameter of the casing (or liner) on the other side, thereby setting the liner hanger 10.

The disclosed slip retention system 14 may provide a mechanical lock for radial deflections, as well as the anti-rotation features 110 for angular deflections. The system may ensure that any axial impact exerted on the c-ring slip 16 is absorbed by the interlocking profile at the retention lip 24 and converted into a radial collapse force that is ultimately transmitted to the liner hanger body 12 via the support sleeve 26. Torsional loads acting on the c-ring slip 16 may also be transmitted into the liner hanger body 12 via the anti-rotation features 110 (i.e., T-slots 112 and anti-rotation shoulders on the support sleeve 26). Both mechanical lock systems may be deactivated, and the c-ring slip 16 extracted from the retention lip 24, via a single axial movement of the support sleeve 26 actuated, for example, by a single hydraulic piston on a liner hanger running tool.

Although the present disclosure and its advantages have been described in detail, it should be understood that various changes, substitutions and alterations can be made herein without departing from the spirit and scope of the disclosure as defined by the following claims.

What is claimed is:

1. A c-ring slip retention system, comprising:

a c-ring slip comprising a radially expandable and compressible c-ring;

a retention lip defining a cavity sized to retain the c-ring slip in a compressed position against an inner wall of the retention lip;

an axially movable support sleeve; and a support ring disposed radially around the support sleeve and disposed in contact with an internal portion of the c-ring slip to bias the c-ring slip against the inner wall of the retention lip.

2. The c-ring slip retention system of claim 1, wherein the c-ring slip comprises a recess along an inner diameter of the c-ring slip sized to receive the support ring.

3. The c-ring slip retention system of claim 1, wherein the c-ring slip comprises a keyed profile, wherein the inner wall of the retention lip comprises a complementary profile.

4. The c-ring slip retention system of claim 3, wherein the keyed profile comprises a first shoulder and a second shoulder extending radially outward from the c-ring slip, wherein the first and second shoulders have different widths or heights.

5. The c-ring slip retention system of claim 4, wherein the second shoulder is closer to an axial end of the c-ring slip than the first shoulder, and wherein the second shoulder has a larger width than the first shoulder.

6. The c-ring slip retention system of claim 1, wherein the support sleeve comprises a sloped face disposed proximate a corresponding sloped face on the c-ring slip.

7. The c-ring slip retention system of claim 1, wherein the c-ring slip comprises a T-slot disposed at one end and the support sleeve comprises an anti-rotation sleeve portion disposed within the T-slot of the c-ring slip.

8. A liner hanger system, comprising:

a c-ring slip comprising a radially expandable and compressible c-ring, wherein the c-ring slip comprises a T-slot formed at one end;

a liner hanger body comprising a retention lip defining a cavity sized to retain the c-ring slip; and an axially movable support sleeve disposed within the liner hanger body, wherein the support sleeve comprises an anti-rotation sleeve portion, wherein the anti-rotation sleeve portion is disposed within the T-slot of the c-ring slip to minimize rotation of the c-ring slip relative to the liner hanger body.

9. The liner hanger system of claim 8, wherein the c-ring slip comprises anti-rotation shoulders on opposite walls of the T-slot, and wherein the anti-rotation sleeve portion comprises anti-rotation shoulders extending toward the anti-rotation shoulders of the T-slot.

10. The liner hanger system of claim 9, wherein the T-slot comprises an expanded portion at an end of the T-slot adjacent to the walls of the T-slot having the anti-rotation shoulders.

11. The liner hanger system of claim 8, wherein the support sleeve extends axially through a dovetail slot formed in the liner hanger body.

12. The liner hanger system of claim 8, wherein the support sleeve comprises a stinger portion extending axially from the anti-rotation sleeve portion into a stinger slot formed in the liner hanger body.

13. The liner hanger system of claim 8, further comprising a support ring disposed around the support sleeve and disposed in contact with an internal portion of the c-ring slip to bias the c-ring slip against an inner wall of the retention lip.

14. A method, comprising:

locking a c-ring slip in an axial position within a retention lip of a liner hanger body via a support sleeve;

minimizing rotation of the c-ring slip relative to the liner hanger body via an anti-rotation portion of the support sleeve interfacing with the c-ring slip; and actuating the support sleeve axially to remove the anti-rotation portion of the support sleeve from an interfacing portion of the c-ring slip and to extract the c-ring slip from the retention lip.

15. The method of claim 14, wherein minimizing rotation of the c-ring slip comprises engaging anti-rotation shoulders on the anti-rotation portion of the support ring with anti-rotation shoulders comprising opposite sides of a T-slot formed in the c-ring slip.

16. The method of claim 15, wherein actuating the support sleeve withdraws the anti-rotation shoulders of the support sleeve away from the anti-rotation shoulders of the T-slot and into an expanded portion of the T-slot.

17. The method of claim 14, further comprising maintaining a stinger portion extending from the anti-rotation portion of the support sleeve within a stinger slot formed in the liner hanger body as the support sleeve is actuated to extract the c-ring slip.

18. The method of claim 14, wherein locking the c-ring slip in the axial position comprises pressing a keyed profile of the c-ring slip against a corresponding profile on the retention lip via a support ring disposed around the support sleeve.

19. The method of claim 18, further comprising withdrawing the support ring into a recess of the c-ring slip in response to axial movement of the support sleeve, and compressing the c-ring slip to a smaller diameter to extract the c-ring slip.

20. The method of claim 14, further comprising expanding the c-ring slip into engagement with a frustoconical tapered surface of the liner hanger body upon extraction of the c-ring slip from the retention lip.

* * * * *